US009776844B2

(12) United States Patent
Micallef

(10) Patent No.: US 9,776,844 B2
(45) Date of Patent: Oct. 3, 2017

(54) PIVOT POWER PACK AND BALANCING FRAME (A MINI LIFTER ATTACHMENT FOR AN ELECTRIC SCOOTER)

(71) Applicant: Emanuel J. Micallef, Mississauga (CA)

(72) Inventor: Emanuel J. Micallef, Mississauga (CA)

( * ) Notice: Subject to any disclaimer, the term of this patent is extended or adjusted under 35 U.S.C. 154(b) by 240 days.

(21) Appl. No.: 14/691,223

(22) Filed: Apr. 20, 2015

(65) Prior Publication Data

US 2016/0304327 A1 Oct. 20, 2016

(51) Int. Cl.
*B66F 9/16* (2006.01)
*B66F 9/24* (2006.01)

(52) U.S. Cl.
CPC ..... *B66F 9/24* (2013.01); *B66F 9/165* (2013.01)

(58) Field of Classification Search
CPC .. B66F 9/165; B66F 9/20; B66F 9/205; B66F 9/22; B66F 9/24
USPC ..... 187/233, 234, 235, 236, 237, 238
See application file for complete search history.

(56) References Cited

U.S. PATENT DOCUMENTS 1,593,103 A * 7/1926 Remde ..... B66F 9/08 187/223
3,086,618 A * 4/1963 Christiansen ..... B66F 9/06 187/222
3,266,599 A * 8/1966 Dearden ..... B66F 9/06 187/229
4,365,921 A * 12/1982 Brouwer ..... B66F 9/06 187/234
4,881,866 A * 11/1989 Harmon ..... B65G 49/061 187/233
6,638,001 B1 * 10/2003 McKinley ..... B60P 1/4407 224/401
6,732,892 B1 * 5/2004 Mangrum ..... B60R 9/06 224/401
7,296,959 B2 * 11/2007 Davis ..... B60R 9/06 224/401
8,297,904 B1 * 10/2012 Schroeder ..... B66F 9/065 414/471
8,327,979 B2 * 12/2012 Lynch ..... B66F 7/24 187/212
2016/0090286 A1 * 3/2016 Belotti ..... B66F 9/12 414/607
2017/0015510 A1 * 1/2017 Ripperda ..... B61D 7/32
2017/0101296 A1 * 4/2017 Morita ..... B60T 13/14

* cited by examiner

*Primary Examiner* — Joshua Rodden

(57) ABSTRACT

The attachment including a Balancing Stability Frame and a Pivot Power Pack When the Balancing Stability Frame is attached to the Pivot Power Pack, the weight of a load that is being lifted is supported by the Pivot Power Pack wheels. When the Pivot Power Pack and Balancing Stability Frame are connected to a mobility scooter, a weight of the operator and a counterbalance attached to the Balancing Stability Frame is equally distributed across all wheels. This design minimizes the amount of weight supported by the scooter, which helps to preserve the durability of the scooter.

33 Claims, 3 Drawing Sheets

PIVOT POWER PACK AND BALANCING FRAME (A MINI LIFTER ATTACHMENT FOR AN ELECTRIC SCOOTER)

TECHNICAL FIELD

The application relates generally to lifting and carrying machines, specifically machines that can be used by people with disabilities.

BACKGROUND OF INVENTION

Traditional lift trucks such as: CA 2571225, TYGARD are used for lifting material and stacking them in shelves with forks that are straight out. These traditional lift trucks are not allowed in most public areas due to safety concerns. Smaller lift trucks are equipped with a base that the operator stands on to drive the machine. Some self-propelled models are also available, but these require the operator to walk alongside the machine. Other hydraulic lifters or hand trucks must be pushed or pulled by an operator. None of these existing lifting and carrying machines can be used by people with physical disabilities.

SUMMARY OF INVENTION

The Pivot Power Pack is different from the existing technology that is currently available because it allows handicapped and injured persons to move skids, pallets and containers of up to 230 lbs. The Pivot Power Pack has been designed with a narrow wheel base which allows a high degree of maneuverability that is beyond the capabilities of the existing technologies outlined above. The Pivot Power Pack has been designed as an attachment for the reliable and widely used electric scooters that are typically used by people with physical disabilities such as the CA 2501090, RICHEY model.

The Pivot Power Pack is designed to distribute the maximum weight it carries, up to of 230 lbs., onto its wheels. The Pivot Power Pack's design also includes a Balancing Stability Frame. When the Balancing Stability Frame is attached, all the weight of the operator and the counter balance is distributed over the Pivot Power Pack's 6 wheels for a 3-wheel scooter or 7 wheels for a 4-wheel scooter. This design minimizes the weight that is supported by the scooter itself.

The Pivot Power Pack (P.P.P.) uses swivel steel wheels with nylon cushions to maneuver. The Pivot Power Pack's Balancing Stability Frame distributes the weight of the load over the centre point of the swivel steel wheels. The main shaft that the P.P.P. pivots on has four bearings that allow it to operate with ease and maximizes its maneuverability.

The track that guides the P.P.P's lifters is oriented to the structure with parallel double pipes to ensure the rigidity and stability of the load. The main actuator on the prototype is 18 inches, but can be operated with different models of actuators that go up to 24 inches in height. Two other actuators tilt back to ensure the stability of the load. The main stabilizers are attached to the main guide. There is a second rail guide that tilts at the same time as the pivot lifter. The second guide has extended rail guides which allow the actuator to reach a maximum height of 24 inches. A welded back plate attaches the rugged steel frame of the Pivot Power Pack to its Balancing Stability Frame via three flanges using a total of six bolts. These flanges are heavy-duty (as shown in the accompanying drawing) to ensure the stability of the Balancing Stability Frame.

Unlike conventional lift trucks, the Pivot Power Pack has another actuator which allows the forks to be folded up to 95 degree angle when no load is being carried. Not only does this design ensure higher safety it also allows for improved maneuverability in tight spots. The Pivot Power Pack's lifters are guided by two rollers, one on the base of the P.P.P and one on the lift rail guide for increased load stability. The Pivot Power Pack's design allows for maximum stability when a maximum load is being carried. The Pivot Power Pack has all required accessories for operation. This includes: its own independent source of power; adjustable rear-view mirrors; and, a control panel that can be adjusted to suit the operator. Each of these functions is controlled by separate switches.

The Pivot Power Pack's Balancing Stability Frame (B.S.F.) is attached to the base of the scooter by two ⅝" bolts and two metal plates, one over and one under, the base of the scooter. The Balancing Stability Frame's rear stability wheels can be adjusted to accommodate heavier operators and heavier loads. These adjustable stability wheels weight are designed to transfer off of the scooter's base and onto the adjustable rear wheel and the Pivot Power Pack's main wheels. When lifting lighter weights (120 lbs or less), the upper portion of the Balancing Stability Frame is not required. The rear stability wheels are attached to the B.S.F. and to the main stem of the scooter's chair underneath its locking mechanism. A counter balance is attached to the front of the rear wheel. The design of the Balancing Stability Frame allows for easy access to the scooter and also incorporates a hand strap for easy mounting and dismounting of the scooter. The design of the scooter itself—including its anti-tip wheels and all other components—and all other parts of the scooter are not changed or modified in any way.

DETAILED DESCRIPTION OF INVENTION

Figure 1:
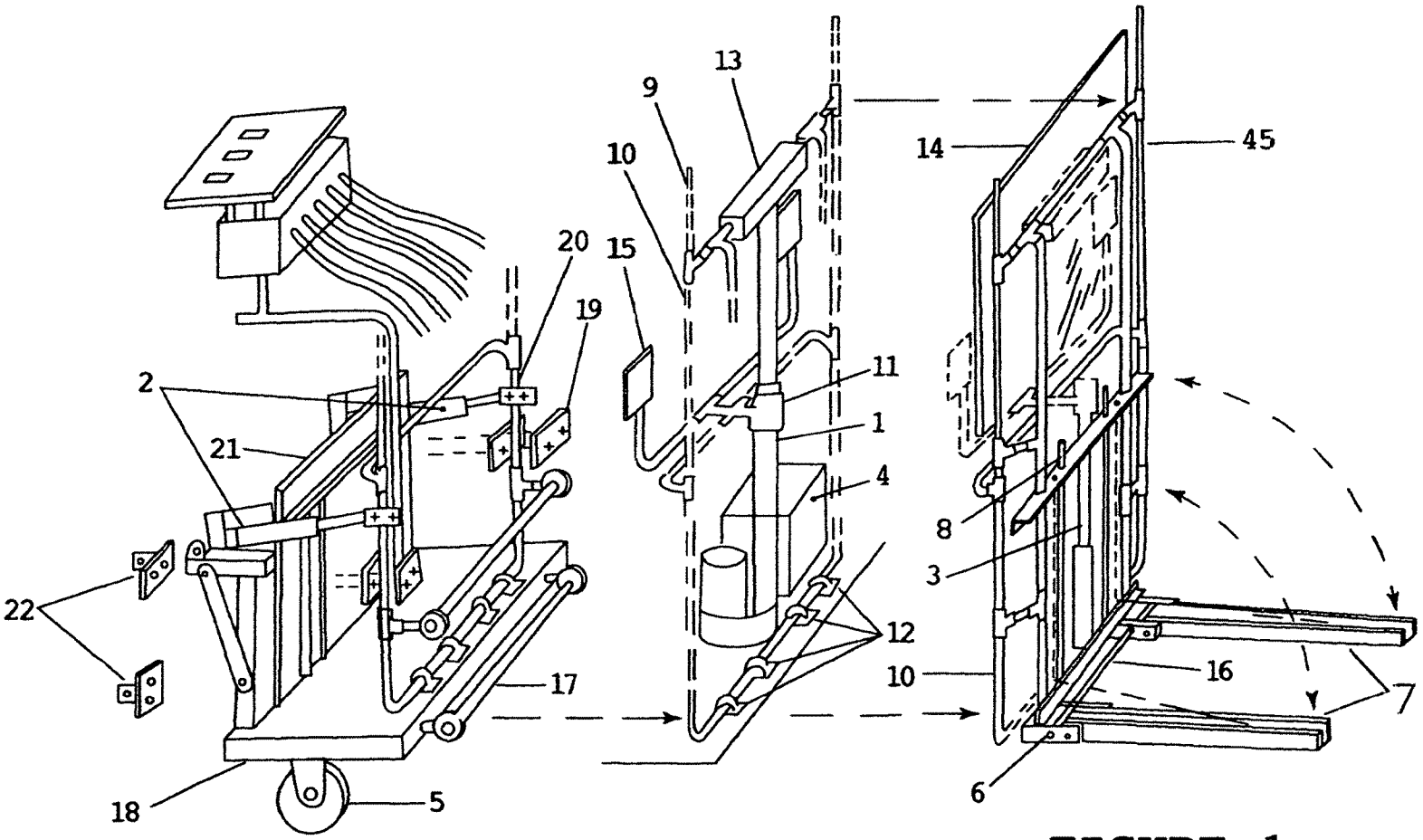
FIG. 1 is a detailed cross-sectional view of the Pivot Power Pack when detached from the Balancing Stability Frame.
Figure 2:
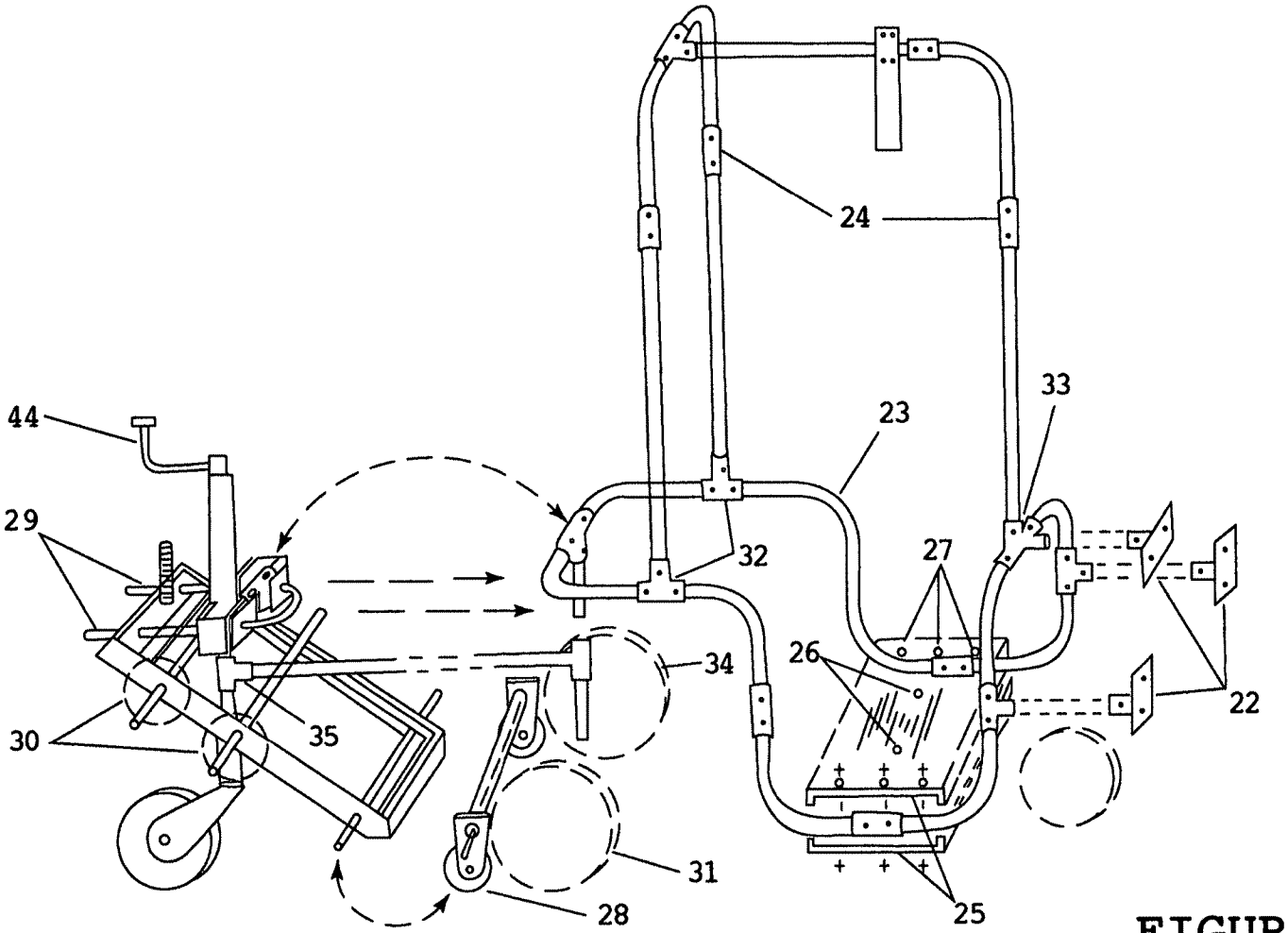
FIG. 2 is a cross-sectional view of the Balancing Stability Frame and adjustable rear wheel with counter balance attachment.

This invention has a rugged steel base (18) with supporting brackets for the back plate (21). The Pivot Power Pack swivel steel wheels (5) are attached with four bolts to the base. They are attached to the mid-point of the base on either side. The swivel steel wheels (5) may have a diameter of about 20 cm, may be rated to support 300 lbs and optionally may be made from cast iron. The Pivot Power Pack wheels (5) consist of steel wheels with a nylon cushion. These nylon cushions reduce friction with the floor when the machine is in motion. This enhances the steering and maneuverability of the Pivot Power Pack. Optionally, the Pivot Power Pack may have a height of about 152 cm above the ground and a width of about 64 cm.

The front of the base has rollers (17) which guides and stabilizes the load as it is being lifted. The support guides (10) has a bracket which has a second roller attached to it, which is located 10" above the main roller (17).

The Pivot Power Pack is designed with rugged bearings (12), four in quantity, which are attached to the base, two on either side of the main lift (1). The main shaft goes through the bearings (12) until halfway on the plate, where a swivel pin is inserted through the actuator (1) with a sleeve that goes through the length of the shaft.

This invention has a unique feature where the forks (7) fold back to 95 degrees for safety purposes when driving without a load. Optionally, the forks (7) may have a length of about 72 cm measured from the pivot location. This feature also enhances the maneuverability while driving in tight spots. The main lifters (45) are coupled at a 90 degree angle that connects to the forks housing which contains a connecting stability bar that goes to the opposite side of the lifter where a similar housing connects. The forks (7) are connected to the housing with heavy duty pins (6) which allow for maximum load. The forks (7) pivot on the heavy duty pins (6) when they fold to 95 degrees. The forks (7) are attached to a steel cable at their ends, with a steel spring that is attached to both the heavy duty pins (6) and the steel cable. This keeps the wire in the channel that is inside the forks (7). This applies for both forks. Each end of the forks (7) has a tapered steel cover that allows pallets to slide over the forks with ease and to protect the steel cable and attached spring. The main lifters (45) have a mounting bracket (16) attached to the bottom of both sides which is also attached to the housing. The forks safety lift actuator (3) is mounted in the centre of the mounting bracket (16). The forks safety lift actuator (3) may be configured to operate on 12 VDC, with a 240 mm stroke, a 135 lbs max law and a speed of about 0.31 m/sec. Attached to the mounting bracket (16) are two lifting guides (8) which have a surrounding sleeve for stability. The top of the lifting guides (8) are attached to the actuator lifting cable bracket. The steel cable used to lift the forks (7) passes through a guide attached to the mounting bracket (16). The steel cable is attached to the actuator lifting cable bracket, which is as wide as the forks (7).

The main lifters (45) are comprised of two doubled sleeves that are the full height of the lifter. The main lifters (45) are attached to the support guides (10) with an additional bracket that attaches to a sleeve that acts as a guide for the main lifters (45). The main lifters (45) are attached with an angled bracket that goes between the sliding support guides (10) and the main lifter actuator bracket (13), attached to the main lift (1). The main actuator (1) is attached to a swivel heavy duty pin, with a spring loaded bracket which is attached to the bracket that is attached to the main guides. The top of the main lifter actuator bracket (13) is attached to a sleeve that goes into the sliding support guide (10). Optionally, the main lifter actuator bracket (13) can be positioned at a height of about 104 cm above the base (18). This sliding support guide (10) guides the main lift (1).

The Pivot Power Pack has its own independent power source (4), which is mounted on an isolator from the steel base. This is attached with a nylon strap to the base. Thus the battery is easily accessible and all four actuators (1, 2*a*, 2*b*, 3) are powered by this single power source (4). All controls and electrical wires are connected to this battery (4). A 30 amp fuse is provided from the battery (4). The battery (4) may be selected to have 35 Amp hours (20 Hrs) and 52 Rev. Cap minutes.

The main lift (1) is attached to the main support bracket (11), which is attached to the support guides (10) on either side. Another bracket is attached to the main support bracket (11) for the rear view mirrors (15). The main lift (1) can be configured to operate on 12 VDC and have a 20:1 gear ratio, a 1500 N max load, a 457 mm stroke, a 26% stroke and may use an acme drive.

Two support brackets attach to the end of the support guides (10) and two brackets at the bottom of the support guides (10) hold a plexiglass safety shield (14).

The load stabilizing actuators (2*a*, 2*b*) are attached to a bracket (20) that is attached to the back plate (21) horizontally. This bracket is supported by another bracket to the back plate (21). The load stabilizing actuator (2*a*, 2*b*) is latched to a bracket with a plate on either side with a swivel pin on the actuator which attaches to the support guide (10). The pin is enclosed around the support guide (10) which sits on an adjustable stopper, one on top (9), one on the bottom. Optionally, the support guide 10 may have a height of about 124 cm. This will allow the amount of tilt forward or backward as desired. This is a heavy duty pin to prevent the pivot from tilting farther than desired. The load stabilizing actuator (2*a*, 2*b*) may be configured to be operable on 12 VDC, have a 120 mm stroke, a 135 lbs max load and a speed of about 0.31 m/sec.

There are two guides that are attached to the back plate (21) which go through the support guides (10). There is an adjustable plate (19) on either side of the guide, one adjusted for the distance that the Pivot Power Pack can tilt backwards, and the other for the distance the Pivot Power Pack can tilt forwards.

Figure 3:
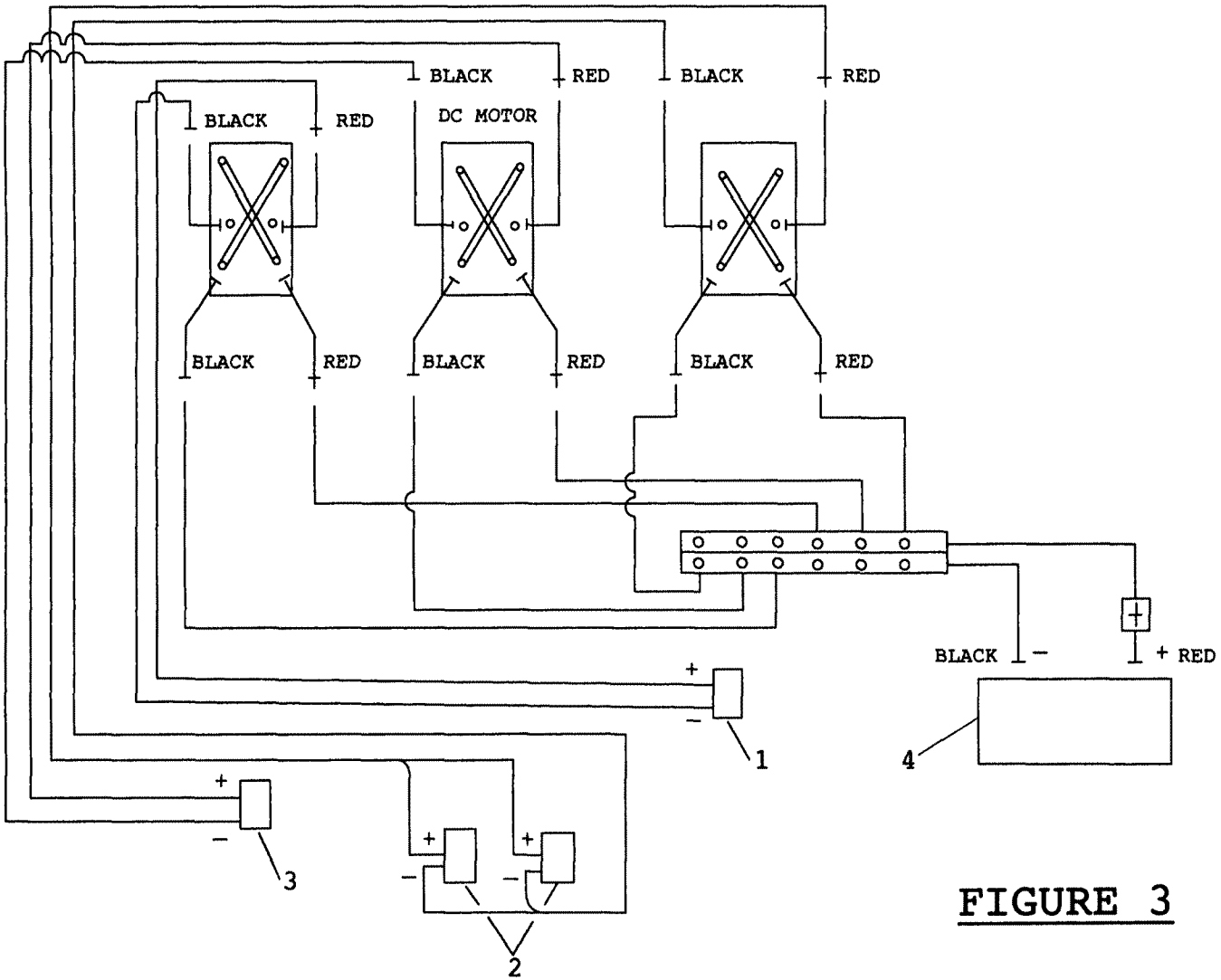
FIG. 3 is a wiring diagram for the Pivot Power Pack control panel.

A bracket is attached to the back plate (21) which is attached to the swivel bracket for the electrical control panel (see FIG. 1A). This control panel comprises of three switches, one for the main lift (1), one for the load stabilizing actuators (2*a*, 2*b*), and one for the forks safety lift actuator (3). This control panel is totally enclosed and a plexiglass cover that protrudes above the electrical box is used to protect the electrical wiring. This cover has complete operating instructions for the Pivot Power Pack. All wiring for each actuator leads separately from the battery to the control panel. The control panel swivels and tilts to operator's specific needs. See FIG. 3A for wiring diagram of the control panel.

The Balancing Stability Frame is constructed of 1.5" steel tubing with heavy duty steel galvanized connectors. All connectors are rated at 7550 lbs.

Three heavy duty flanges (22) (rated at 7550 lbs) with two bolts each, attach the Pivot Power Pack back plate (21) to the Balancing Stability Frame. These are attached with ⅝" bolts with wing nuts on the Balancing Stability Frame side for easy detachment.

The upper portion of the Balancing Stability Frame attaches to the main upper flange (33) of the Balancing Stability Frame. This vertical portion of the frame attaches to a horizontal upper frame, where a hand strap is mounted, for easy mounting and dismounting of the scooter. The horizontal upper portion of the Balancing Stability Frame is connected to a T-Connector that is connected to a bracket that is the width of the frame. This bracket is connected with sleeves (24) to vertical tubing which is connected to another T-Connector (32) on either side. This T-Connector (32) is connected to an elbow (23) which is connected to horizontal tubing that goes through the bottom of the scooter and then to the flanges (23) in front.

At the bottom of the vertical tubing at the T-Connector (32), two elbows (23), one on either side, are connected to another T-Connector at the back. Vertical tubing connects this T-Connector to the swivel connector (35) which is attached to a bracket that connects the swivel connector (35) to the seat stem (34) below the seat attachment.

The adjustable rear wheel is connected to the swivel connector (35) and the counter balance bracket. The counter weight bracket makes a 45 degree angle with the rear wheel. This connects to the outside of the anti-tip wheels (28).

The counter weight bracket houses one 25 lbs weight (30) and two 10 lbs weights on either side. The rear adjustable wheel has an adjustment control (29) which controls the height of the counter balance bracket. The connecting bracket between the swivel connector (35) and the seat stem (34) is attached to the counter balance bracket.

The adjustable rear wheel is a ten inch swivel rubber tire. The adjustable rear wheel also has a manual adjustable handle (44) to lower or raise the wheel to compensate for heavier operators and to balance the overall weight of the counter weight attachment with the operator. This also transfers this weight proportionally to the Pivot Power Pack's steel wheels. This will ensure even weight distribution.

The base of the scooter requires two ⅝" holes where no electrical wires or structural support exists. Two heavy duty steel plates (25), one on top of the scooter base, one below, have full width gaskets (cushions). The top steel plate has a non-skid rubber attachment which covers the two ⅝" bolts (26) that go through the two metal plates and the scooter. Both sides of the plates contain ⅜" bolts (27) that clamps the Balancing Stability Frame to the scooter. This creates a positive attachment to the base of the scooter. The non-skid rubber attachment also covers the ⅜" bolts (27). This gives a ground clearance of 9 cm.

The counter weight and rear wheel bracket is a heavy duty unit, which allows for heavier counter weights to be used. This also contains a provision for additional counter weights if required.

The Balancing Stability Frame is designed to give easy access and stability to mount and dismount the scooter. The radius of the design and the upper horizontal bar creates a stable attachment to the Pivot Power Pack. The adjustable rear wheel is designed to ensure that the front of the scooter maintains steering ability at all times with the maximum load on the Pivot Power Pack.

The Pivot Power Pack, with its Balancing Stability Frame, is designed to be used only indoors, on level surfaces when attached to a regular mobility scooter. Its compact design can lift a maximum load of 230 lbs. This is achieved by using similar principles to those utilized by hydraulic pump trucks which enable employees to easily transport heavy skids weighing 300 lbs. or more across flat surfaces with minimal effort.

The Pivot Power Pack has been designed specifically to assist people with physical disabilities to access employment opportunities in the: manufacturing, distribution, retail, commercial, hospitality health care and retail sectors—anywhere where the lifting and transporting of goods is required. With its compact design and high degree of maneuverability, the Pivot Power Pack is ideally suited for environments where load weights are smaller (up to 230 lbs.) and where larger, traditional lift trucks cannot be utilized.

The invention claimed is:

1. A combination of a balancing stability frame for attaching to a seat stem of an electric scooter having a base, and a pivot power pack, the balancing stability frame comprising:

a top steel plate configured to cover a top surface of the base;

a bottom steel plate configured to cover an opposed bottom surface of the base;

at least two attaching bolts securing the top steel plate to the bottom steel plate and passing though the base;

a rubberized gasket disposed between the bottom steel plate and the bottom surface of the base; and a non-slip rubber cover disposed on the top steel plate and covering the attaching bolts;

and the pivot power pack for connecting to said scooter, the pivot power pack comprising;

a steel base having a width;

a main shaft pivotally coupled to the base by four bearings;

a plurality of main telescopic sliding guides pivotable connected to said main shaft;

a plurality of vertical sleeved sliding lifters slidingly coupled to the plurality of main telescopic sliding guides and slideable in unison with each other to lift a load; and two guide rollers coupled to the base and extending the full width of the base of said pivot power pack to guide the movement of the vertical sleeved sliding lifters whereby said guided movement stabilizes the load on the vertical sleeved sliding lifters;

wherein the balancing stability frame is attachable to the electric scooter without changing an original state of the electric scooter with the exception of two holes in a base of the electric scooter for attaching the balancing stability frame to the scooter, and wherein the pivot power pack is attachable to the balancing stability frame.

2. The combination of claim 1, wherein the balancing stability frame comprising an access to the scooter without inhibiting operator access to the scooter.

3. The combination of claim 1, wherein the balancing stability frame comprising a swivel coupling for attaching to said scooter.

4. The combination of claim 1, wherein the balancing stability frame comprising an adjustable swivable rear wheel enhancing the stability and the balance of the balancing stability frame.

5. The combination of claim 4, wherein the swivel rear wheel comprises a counter balance attachment attached to a bracket for stabilization of the steering of the scooter, said counter balance attachment is mounted with a removable pin permitting an amount of weight to be easily changed.

6. The combination of claim 4, wherein the rear wheel comprises a manual adjustment for different operators and for different sized loads.

7. The combination of claim 1, wherein the balancing stability frame comprises a hand strap at an upper horizontal bar for easy mounting and dismounting.

8. The combination of claim 1, wherein the balancing stability frame comprises three flanges attachable with wing nuts for easy detachment from the pivot power pack.

9. The combination of claim 1, wherein the balancing stability frame comprises three flanges attachable with a threaded nut and bolt arrangement or a magnetic coupling.

10. The combination of claim 4, wherein said rear wheel is detachably connected with said seat stem without removal of a seat.

11. The combination of claim 1, wherein the top steel plate and the bottom steel plate comprise three of said attaching bolts to secure the balancing stability frame to the base of the scooter.

12. The combination of claim 1 wherein the balancing stability frame is connectable to any one of a three wheel scooter, four wheel scooter, or scooter of any width.

13. The combination of claim 1, wherein an upper portion of the balancing stability frame is removable when lifting lighter loads.

14. The combination of claim 1, wherein the pivot power pack comprises said steel base and a back plate, attachably connected to two swivel steel wheels with nylon cushions.

15. The combination of claim 1, wherein the main lifters comprises double tubular sleeves for rigidity, each of the main telescopic guides comprise an attachment mounted parallel to the double sleeved tubular sliding guides to stabilize the sliding lifters into position when the load is being lifted or lowered.

16. The combination of claim 1, wherein the base of the vertical sleeved sliding lifters comprise a mounting bracket for mounting an actuator for the tilting of forks between 0 and 95 degrees for safety and maneuverability without a load.

17. The combination of claim 16, wherein the bottom of the vertical sleeved sliding lifters comprise a heavy duty pivoting pin and a fork leveling adjustment for attachment to a housing.

18. The combination of claim 17, wherein said forks comprise a spring attachable to said heavy duty pivoting pin, as well as to the front of the forks with a steel cable, the steel cable sits in groove provided in the forks; and a cover plate provided to protect the cable and said spring when lifting pallets.

19. The combination of claim 18, wherein the steel cables are attachable to both sides of guide in the mounting bracket to both housings for the heavy duty pivoting pins which attach to the bracket of a forks safety lift actuator.

20. The combination of claim 19, wherein the forks safety lift actuator has two lifter guides with a sleeve for rigidity.

21. The combination of claim 1, comprises an actuator adjacent of said pivot power pack attachably connected to said main guides wherein said actuator stabilizes said load.

22. The combination of claim 21, wherein the pivot power pack comprises a controllable safety adjustment to limit the tilting range of the pivot power pack.

23. The combination of claim 1, wherein said main telescopic guides of said pivot power pack comprise an attached sliding sleeve that is the full length of the vertical sleeved sliding lifters but compensated by 30 cm to accommodate an actuator that lifts up to 60 cm in height.

24. The combination of claim 1, wherein said main sliding telescopic guides are attachable to a main guide further comprising a plexiglass shield to protect the operator.

25. The combination of claim 1, wherein the pivot power pack comprises a recessed first bracket that extends the full length of the main telescopic guides, attachable to a top of a main actuator by a coupling for stability of the main actuator.

26. The combination of claim 25, wherein the main actuator comprises a pin that goes through the full length of the base with a double sleeve for rigidity and to promote less friction when carrying said load.

27. The combination of claim 26, wherein the top of the main actuator comprises a spring loaded pin attachable to a second bracket and to a third bracket that is between the main guide and the main lifter guides, both said brackets are attachable to each other, enhancing the pivoting ability of the main actuator to maintain steady loads, wherein the spring loaded pin prevents the main lifter from shifting.

28. The combination of claim 27, wherein the main lifter comprises a fourth bracket supporting two rear view mirrors.

29. The combination of claim 1, wherein a back plate of the pivot power pack has a bracket that houses an adjustable swivable pivotable control panel, said control panel being adjustable by the operator.

30. The combination of claim 29, wherein the control panel houses all wiring for the pivot power pack, comprising at least three switches for the pivot power pack control panel including one for the main actuator, one for the stabilizing actuators and one switch for lifting the forks between 0 and 95 degrees.

31. The combination of claim 29, wherein the back plate comprises welded bolts attachable to the balancing stability frame to permit easy detachment.

32. The combination of claim 30, wherein when the back plate is detached from the balancing stability frame, said pivot power pack is free-standing when the forks are tilted to 95 degrees and the housing is resting on the ground.

33. The combination of claim 31, further comprising an independent power source comprising a battery that is strapped to the back plate.

* * * * *